US005211363A

United States Patent [19]

Brown

[11] Patent Number: 5,211,363

[45] Date of Patent: May 18, 1993

[54] BILGE PUMP BRACKET

[76] Inventor: John S. Brown, P.O. Box N716, Nassau, The Bahamas

[21] Appl. No.: 835,770

[22] Filed: Feb. 14, 1992

[51] Int. Cl.[5] ..... B63J 5/00

[52] U.S. Cl. ..... 248/146; 114/183 R; 248/300

[58] Field of Search ..... 248/146, 220.1, 300, 248/311.2, 346, 637, 671, 674, 676, 678, 154; 114/183 R, 184; 137/397, 899.2

[56] References Cited

U.S. PATENT DOCUMENTS 4,727,815 3/1988 Miller ..... 248/220.1 X
4,932,348 6/1990 Nix et al. ..... 114/183 R
4,949,929 8/1990 Kesselman et al. ..... 248/220.1 X
5,009,385 4/1991 Burgener et al. ..... 248/346
5,015,900 5/1991 Morrill ..... 248/678 X

*Primary Examiner*—Ramon O. Ramirez
*Assistant Examiner*—Derek J. Berger

[57] ABSTRACT

A bilge pump bracket of generally an "L" shape allows the bilge pump and float switch to be mounted outside of the bilge area, usually in the workshop. The base of the bracket has a location thereon where the pump is to be mounted. In addition, the base also has a raised float switch platform which provides for assurances that the pump will shut off when bilge water is below a predetermined level. Further, the bracket, when made of plastic, can be molded to fit the hull of a vessel by slightly heating the bracket angle to conform to any angle of the vessel's transom area.

6 Claims, 1 Drawing Sheet

BILGE PUMP BRACKET

FIELD OF THE INVENTION

The present invention relates to a bracket for holding a bilge pump and securing it to a marine vessel. More specifically, a bilge pump bracket is provided which allows for easy installation and removal of the bilge pump without the hereinafter difficulties discussed below.

BACKGROUND OF THE INVENTION

Bilge water is that water which enters a marine vessel by any means and lies upon her inner bottom or bilge area. If there is too much bilge water within the bilge area, a possibility exists that the vessel may become unseaworthy. In a worst case scenario, it is even possible that a vessel will sink if there is an excessive amount of bilge water.

In order to overcome this potentially dangerous situation of sinking, bilge pumps have been installed within the bilge area to express excessive water that lies therein. The bilge pump may be activated by a float switch. Once bilge water exceeds a certain level, that water level activates the float switch which turns the pump on and bilge water is thus pumped out. Once enough water has receded from the bilge area to a point below the float switch, the switch is deactivated and the bilge pump turns off.

The installation of a bilge pump and float switch, with accompanying electrical wires to connect the two items to the vessel's energy source, is oftentimes quite difficult for several reasons. First, the bilge area is usually located in a very cramped space located at the hull's interior of a vessel. Generally there is a floor board located above the bilge area which further restricts access to that area. This narrowed space is difficult to get to for the average sized individual who might need to install or otherwise maintain a bilge pump within that area Second, the bilge water is darkened by impediments within the water. It is also foul smelling. One does not want to spend any extended period of time within the bilge area to install or maintain a pump for this reason. Third, since the bilge water is murky, it is difficult to see through in order to secure a pump to a bilge platform which is on the bottom of the hull's inside. In this regard, when an installer attempts to screw in a bilge pump onto the bilge platform, the screws may be inserted improperly. This may result in an improperly installed pump. Further, there is the possibly that the screw will go through the hull resulting in a breach thereof. Additionally, if a screwed hole is ever separated from the screw, it is difficult to relocate that position as it is under the bilge water.

Another problem occurs when the float switch is mounted at the same level of the bilge pump on the platform. When this happens, the water may not drop to a level where the switch shuts off. The ensuing result is that the pump can burn itself out. Further, once the pump is mounted within the bilge area, it is very time consuming to complete the wiring unless the pump is capable of being prewired outside the installation area.

SUMMARY OF THE INVENTION

It is the primary objective of the present invention to overcome the above stated problems of bilge pump installation and maintenance. A bilge pump bracket of generally an "L" shape allows the bilge pump and float switch to be mounted outside of the bilge area, usually in the workshop. The base of the bracket has a location thereon where the pump is to be mounted. In addition, the base also has a raised float switch platform which provides for assurances that the pump will shut off when bilge water is below a predetermined level. Further, the bracket, when made of plastic, can be molded to fit the hull of a vessel by slightly heating the bracket angle to conform to any angle of the vessel's transom area.

The bracket mount can easily be secured to a stringer, a longitudinal or transverse support beam, or the transom of the vessel by one or more self tapping screws. This advantage allows the installer to effectively secure the bilge pump and float switch onto a vertical beam which eliminates the difficulty of securing those parts into the floor of the vessel through the standing bilge water. This method also ensures against the accidental drilling of a securing device through the bottom of the vessel.

It is still another object of the present invention to allow the pump and float switch to be prewired outside of the bilge area, generally within the workshop.

Yet another object of the present invention provides for easy removal of both the pump and float switch when maintenance or repair is required.

DRAWINGS OF THE INVENTION

The above and other objects of the invention will be more fully apparent and understood from a consideration of the following detailed drawings, wherein:

FIG. 1 a perspective view of the bilge pump bracket.

FIG. 2 is fragmented, crosssection side view of a marine vessel utilizing the bilge pump bracket; and FIG. 3 is a fragmented, perspective view of the bilge pump bracket attached to a marine vessel's transverse support beam.

DESCRIPTION OF A PREFERRED EMBODIMENT

Figure 1:
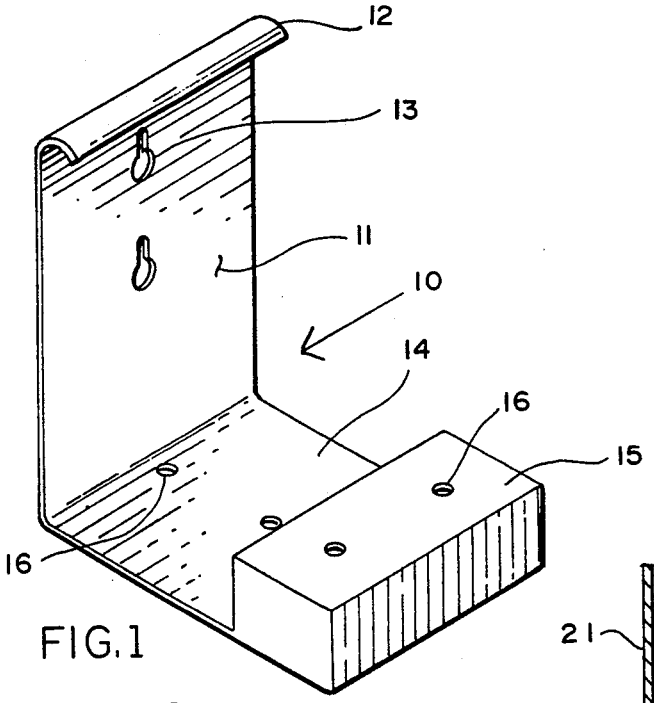

Referring to FIG. 1, bracket 10 is shown having a bracket back 11. The top end of the bracket back 11 terminates in a curvilinear fashion creating a hand grip 12 section. The hand grip 12 allows installers to easily grasp the bracket 10 when installing or removing it. The bracket back also has a number of mounting holes 13 which provides for attachment to a transverse or longitudinal support beam, e.g. the transom, situated on the marine vessel.

The bottom end of the bracket 11 terminates with a substantially perpendicular bracket base 14. The substantial perpendicularity generally creates an "L" shaped bracket 10. The bracket base 14 terminates at its free end not attached to the bracket back 11, with a raised platform 15. While any reasonable dimensions for the bracket 10 will suffice, it is preferred that the bracket back 11 be approximately 18 inches in length and the bracket base 14 be approximately 10 inches in length which includes a 3 inches in length platform. Further, the float switch platform 15 should be raised at least one-half inch above the bracket base 14.

While the bracket 10 may be made of any type of suitable material, it is preferred that it be made of plastic. When so manufactured, the point at which the back 11 adjoins the base 14 may be heated slightly to reconfigure the general "L" shape to conform to the dimensions of most any vessel. If non-malleable materials are used to manufacture the bracket 10, then a hinge will be necessary if it is desired to conform the bracket shape to the vessel's hull shape.

Figure 2:
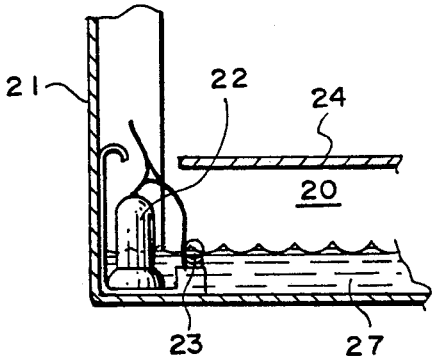
Figure 3:
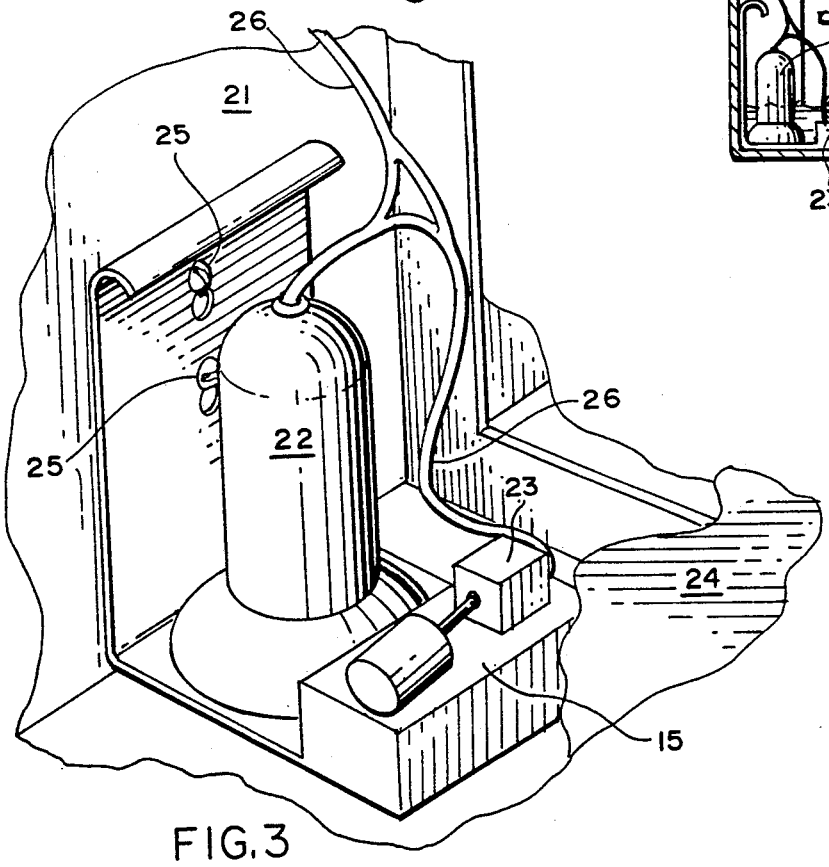

Further in FIGS. 2 and 3, the bracket 10 is placed within the bilge area 20 of a typical marine vessel 30. The vessel's floor board 24 substantially covers the bilge area 20 except for a small open section which gives access to the bilge area 20. A bilge pump 22, float switch 23, and the wiring 26 therefore are secured to the bracket 10 outside of the bilge area 20 and the vessel 30. The bilge pump 22 and float switch 23 are secured to the bracket base 14 and platform 15, respectively, at their respective mounting holes 16 by means such as screws. The bracket 10 is secured to the vessel, e.g. its transom 21, by positioning self-tapping screws 25 directly into the transom 21 or other supporting beam. In fact, any type of securing means other than self-tapping screws 25 may be used.

The bracket 10 may be lowered into the bilge area 20 with one's hand (shown in phantom lines) over the self-tapping screws 25. Thereafter, the bilge pump 22 and float switch 23, and other grounding wires may be attached to an energy source such as the vessel's battery.

Once bilge water exceeds the level of the float switch 23, that switch is turned on thus activating the bilge pump 22. The pump 22, when activated, pumps bilge water 27 out of the bilge area 20. When the remaining bilge water 27 is at a level below the float switch 23, that switch disengages thus completing the bilge pumping process until the bilge water 27 rises again.

It is intended that the description of the preferred embodiment of this invention is illustrative only. Other embodiments of the invention that are within the scope and concept of it are herein included and made a part of this application.

What I claim is:

1. A bilge pump bracket comprising, a bracket back and a bracket base, said bracket back being adjoined to the bracket base thus creating an "L" shape, said back terminating curvilinearly thus forming a hand grip and having a means for releasably securing the said back to the bilge area of a marine vessel, and said base terminating in a platform which is raised in a steplike manner with respect to the said base and contiguous therewith, said base having a means for securing thereon a bilge pump and said platform having a means for securing a float switch thereon.

2. The bilge pump bracket of claim 1, said releasable securing means for the back comprising screws.

3. A bilge pump bracket comprising, a bracket back and a bracket base, said bracket back being adjoined to the bracket base thus creating an "L" shape, said bracket back terminating curvilinearly thus forming a hand grip and having a means for releasably securing the said back to the bilge area of a marine vessel, and said base terminating in a platform which is raised in a steplike manner with respect to the said base and contiguous therewith, said base having a means for securing thereon a bilge pump and said platform having a means for securing a float switch thereon, and; where the junction of the said back and base has a means for creating a flexible angulation.

4. In the bilge pump bracket of claim 3, said means for creating a flexible angulation comprising a plastic bracket wherein the junction is heated and manipulated to the desired angle to conform said bracket to the bilge area of a marine vessel.

5. An automated system for pumping bilge water from the bilge area of a marine vessel, said system comprising a bilge pump bracket said bracket having generally an "L" shape formed from a bracket back and a bracket base, said bracket base having a free end wherein said free end terminates in a platform which is raised with respect to the base and is contiguous therewith in a steplike relationship thereto, said bracket base having a means to secure a bilge pump thereon, and said platform having a means to secure a float switch thereon, such that when said bracket is installed within the bilge area, and bilge water raises to the level of the said float switch, the said switch is engaged thus activating the said pump to reduce the bilge water to a level below the engagement point of the said switch.

6. In the automated system for pumping bilge water from the bilge area of a marine vessel of claim 5, said securing means comprising screws.

* * * * *